US006068561A

United States Patent [19]

Renard et al.

[11] Patent Number: 6,068,561

[45] Date of Patent: May 30, 2000

[54] MULTI-LAYER GOLF BALL AND METHOD OF MANUFACTURING

[75] Inventors: Philippe Renard, Carlsbad; Dean Snell, Oceanside, both of Calif.

[73] Assignee: Taylor Made Golf Company, Inc., Carlsbad, Calif.

[21] Appl. No.: 08/896,996

[22] Filed: Jul. 21, 1997

[51] Int. Cl.[7] ..... A63B 37/12

[52] U.S. Cl. ..... 473/364; 473/354; 473/376

[58] Field of Search ..... 473/378, 364, 473/365, 376, 354

[56] References Cited

U.S. PATENT DOCUMENTS

| | | | |
|---|---|---|---|
| 4,337,946 | 7/1982 | Saito et al. . | |
| 4,919,434 | 4/1990 | Saito . | |
| 5,184,828 | 2/1993 | Kim et al. . | |
| 5,253,871 | 10/1993 | Viollaz . | |
| 5,273,286 | 12/1993 | Sun | 473/376 X |
| 5,314,187 | 5/1994 | Proudfit | 473/378 X |
| 5,439,227 | 8/1995 | Egashira et al. . | |
| 5,688,595 | 11/1997 | Yamagishi et al. | 473/378 X |
| 5,725,442 | 3/1998 | Higuchi et al. | 473/378 X |
| 5,730,665 | 3/1998 | Shimosaka et al. | 473/378 X |
| 5,743,816 | 4/1998 | Ohsumi et al. | 473/378 X |
| 5,749,796 | 5/1998 | Shimosaka et al. | 473/365 |
| 5,752,888 | 5/1998 | Maruko et al. | 473/378 X |
| 5,762,568 | 6/1998 | Kato | 473/378 X |
| 5,772,530 | 6/1998 | Kato | 473/365 X |
| 5,772,531 | 6/1998 | Ohsumi et al. | 473/378 X |
| 5,816,937 | 10/1998 | Shimosaka et al. | 473/364 |
| 5,830,086 | 11/1998 | Hayashi et al. | 473/378 X |

FOREIGN PATENT DOCUMENTS 2278609 1/1994 United Kingdom .

*Primary Examiner*—Mark S. Graham

*Attorney, Agent, or Firm*—Knobbe, Martens, Olson, & Bear, LLP.

[57] ABSTRACT

A golf ball consisting of a multi-piece cover surrounding a core. The cover consists of a multi-sheet structure which includes at least three thin layers of thermoplastic with each layer having a thickness of no more than 0.030 inches. The hardness of the multi-sheet structure varies between adjacent layers so that the reaction of the ball varies depending upon the amount of deformation of the ball upon impact with a golf club. The method of manufacturing a golf ball includes producing a cover from a multi-layer member, with at least one layer having a thickness of no more than 0.030 inches.

23 Claims, 10 Drawing Sheets

MULTI-LAYER GOLF BALL AND METHOD OF MANUFACTURING

BACKGROUND OF THE INVENTION

The present invention relates to golf balls. More particularly, the present invention relates to a golf ball having a cover consisting of a plurality of layers having physical properties that vary as a function of ball thickness.

Golf balls generally consist of an internal core surrounded by a cover. The core is typically either a solid rubber core or a wound core. FIG. 1 shows a two-piece ball construction having a rubber core 20 surrounded by a relatively thick thermoplastic cover 22 with dimples 24. The cover 22 is often mounted over the core 20 by injection-molding or by heat-molding together two "half cups" that are produced by injection.

Generally, the core consists of a soft material that resiliently deforms upon impact with a golf club. As it resumes its shape, the core propels the ball from the club face. The core is thus the "engine" which largely determines the distance the ball travels upon being struck with a club. On the other hand, the cover is hard relative to the core. Because the outer portion of the cover contacts the club face, the cover determines the feel of the ball at impact. The softness of the cover also determines the ball spin rate. Generally, if the cover is soft, the spin rate of the ball increases and improves the feeling of the ball when struck. However, the drawback of a soft cover is a significant loss in the ball distance. On the other hand, when the cover is hard, the ball travels farther but the spin rate reduces so that the ball is more difficult to control with the short clubs, such as for example, when the ball is manufactured of high flexural modulus ionomers. Thus, with the current two-piece construction a manufacturer must choose between acceptable distance characteristics and acceptable feel and control characteristics.

Manufacturers have attempted to make golf balls with multiple layers in order to resolve the apparent contradictory relationship between the distance characteristics and the control and feel characteristics of a golf ball. FIG. 2 illustrates a three-piece golf ball that consists of a solid core 20, a mantle 21 of thermoplastic material, and a cover 22 manufactured of a different thermoplastic material. A three-piece golf ball generally allows a manufacturer more latitude in varying the physical and dimensional properties of the ball. A conventional cover generally includes only one or two layers having thicknesses between 0.050 and 0.095 inches so that the cover is resistant to cutting and abrasion while still providing the ball with sufficient rebound properties.

U.S. Pat. No. 5,253,871 to Viollaz discloses a three-piece golf ball having an elastomer core, a mantle, and a cover. In the Viollaz patent, the cover is a single layer of a predetermined hardness, with a thickness of at least 0.035 inches. The mantle has a hardness different from that of the cover. The mantle thickness ranges between 0.039 to 0.118 inches. Although the three-piece construction of Viollaz allows a manufacturer more latitude in adapting the ball to the various conditions of a game, it also has certain drawbacks, particularly the hard and thick cover which generally does not provide sufficient spin upon impact.

U.S. Pat. No. 5,439,227 to Egashira also discloses a three-piece ball. The ball has a soft mantle and a hard cover. The cover thickness ranges between 0.058 and 0.106 inches. The ball construction disclosed by Egashira has the same drawbacks described above with respect to the previous reference.

U.S. Pat. No. 5,184,828 to Kim discloses a golf ball having a double core of variable hardness. According to Kim, the variable distribution of hardness allows a high energy to accumulate in the region of differing hardness. However, because of the relatively large distance between the core and the cover, the hardness variation only affects the core of the ball and not the surface of the ball when the ball is struck. Consequently, when the ball is struck with a short iron, which provides relatively little deflection to the cover, the core provides little or no significant effect on the ball spin.

U.S. Pat. No. 4,919,434 to Saito discloses a two-piece golf ball consisting of a solid core and a cover having a thickness of 0.4 to 2.2 mm thick. The cover consists of a 0.1 to 2 mm inner layer and 0.1 to 1.5 mm thick outer layer enclosing the inner layer. Both the inner layer and outer layer are made of thermoplastic resins, with the inner layer being a soft thermoplastic resin. The outer layer is formed of a harder thermoplastic resin having a flexural modulus of 2000–5000 $Kg/cm^2$. However, Applicant has observed that only two graduations of hardness around the core does not sufficiently enhance the characteristics of the ball, particularly the cover hardness. Thus, Saito does not produce a cover that is optimized for each club in a set.

According to USGA rules, a player can have a maximum of fourteen clubs in a bag. A typical set of clubs includes three woods of different lofts, 10 to 12 irons, and one putter. Depending on various factors, including the type of club and the head speed, the ball deforms differently against the club face and experiences differing momentum upon impact. In particular, the percentage of inward deformation of the ball reduces gradually from the driver or other long clubs to the shorter clubs. Furthermore, except for the putter, the momentum of the ball increases in the direction of deformation, resulting mainly from the increase in the loft angle of the club face. A set of clubs is intentionally arranged to provide increased control over the ball as the club length shortens.

The balls of the prior art, such as the ball disclosed by Saito, are not configured to perform optimally with each club in a set, or at least each of the principle clubs in the set. For example, in the Saito patent, the ball cover must have a minimum thickness to protect the core and to provide proper resistance against abrasion and cuts. If one of the layers is made thin, the thickness of the other layer must be increased in order to preserve the minimum thickness. The ball properties, particularly hardness, are controlled by the thickest layer. For instance, if the soft inner layer is made thin to provide the ball with increased distance, the harder outer layer must be made thicker so that the ball has a hard feel and poor control. On the other hand, if the hard outer layer is made thin to improve feel, the soft inner layer must be made thicker, which improves feel but reduces distance. Thus, it is not possible with only two layers to optimize both ball distance for the long clubs and ball control for the short clubs while also maintaining the minimum cover thickness for durability.

Because the ball deformation gradually reduces from the driver to the short clubs, there is a need to precisely adjust the ball hardness so that the ball reacts differently depending on the amount of deformation that the ball experiences at impact. That is, ball performance would be optimized if the properties of the ball as a function of inward distance were particularly suited to the various types of clubs. For example, the hardness of the outer layers of the cover may be optimized for putters depending on whether a golfer prefers a soft or hard putting feel. Likewise, the hardness of the intermediate layers could be optimized for pitching wedges, which deform the ball slightly inward into the cover. The hardness characteristics of the innermost layers should be optimized for the wood-type clubs, which produce the greatest inward deformation, often deforming the center of the ball.

None of the prior patents have sufficiently dealt with the need to adapt the structure of the ball to the various degrees of deformation that occur upon impact with different golf clubs.

There is therefore a need for a multi-layer golf ball having a structure that is adapted to respond optimally for each club used during a game. Such a golf ball should have equal or better flight performance characteristics than a conventional ball when struck by a driver or any similar long club, as well as when struck by a middle iron and a short iron. The ball should also be designed to impart a soft or a hard feel when hit by a putter, depending upon the golfer's particular preferences.

SUMMARY OF THE INVENTION

The present invention relates to a golf ball which consists of a core surrounded by a cover. The cover has a multi-layered structure which comprises at least three layers, and preferably more than three layers. Each of the layers have different hardness characteristics so as to provide a variation of hardness to the multi-sheet structure. Preferably, each layer is a thin layer having a thickness of less than or equal to 0.030 inches.

Such a golf ball structure having at least three thin layers advantageously allows for precise hardness gradients within the ball to optimize the ball properties of rebound, spin, softness, etc., for each type of club that is used during the game, while also maintaining the minimum thickness of the cover to provide durability. The preferred embodiment of the golf ball described herein produces equal or better flight performance relative to prior art balls when struck by a driver. This golf ball also exhibits improved characteristics in controllability and feel when struck by a middle iron, short iron or putter. In accordance with the present invention, the size and hardness of the thin layers of the multi-layered structure may be varied depending upon the various needs of the players.

Preferably, the hardness varies from one layer to another adjacent layer to provide a gradual change of hardness within the multi-layered structure. This provides the manufacturer with increased ability to tune the properties of the cover toward the various clubs depending upon the deformation to which the cover is subjected. In one embodiment, the hardness within the multi-sheet structure gradually decreases from the innermost layer to the outermost layer. When a driver strikes the ball, the cover deforms until the club face deforms an inner layer harder than the outer layers to thereby impart a solid rebound to the ball. When a short iron strikes the ball, the club face only deforms the outer softer layers to confer more spin and a good feel to the ball.

In another embodiment, the hardness of each layer increases gradually from the innermost layer to the outer layers. In this embodiment, the outer layer preferably has a hardness that is greater than its adjacent inner layer. This embodiment provides a more solid feel upon impact with a putter, while also providing a soft feel and high spin for the short irons and high restitution for the longer clubs.

One aspect of the invention relates to a golf ball comprising a core and a multi-layered structure surrounding the core which comprises at least three thin layers, wherein the at least three layers have a different hardness so as to provide a variation of hardness within the multi-layered structure and the layers have a thickness of less than or equal to 0.030 inches. Desirably, the hardness within the multi-layered structure varies from one layer to another adjacent layer, such as decreasing from its innermost layer to its outermost layer. In one embodiment, the layers comprise thermoplastic. In another embodiment, the hardness within the multi-layered structure increases from its innermost layer to its outermost layer.

In one embodiment of the golf ball, the core comprises a single solid rubber core, which may be covered with wound rubber thread. In another embodiment, the core comprises a liquid or paste filled core, covered with wound rubber thread.

In yet another embodiment of the golf ball, the hardness of the multi-layered structure decreases from the innermost layer toward the surface of the cover, with the outermost layer having a hardness which is higher than the hardness of its adjacent inner layer. The center desirably comprises an inner rubber core and an outer thermoplastic mantle having a thickness that is higher than the 0.030 inches.

The layers are desirably formed from ionomers or thermoplastic elastomers, or mixtures thereof. Thermoplastic elastomers are desirably chosen among the ether block copolymers or thermoplastic urethane elastomers. The ether block copolymer is preferably an amide block copolyether.

Another aspect of the invention relates to a method of manufacturing a golf ball having a center and a cover comprising the steps of producing the cover from a multi-layer member comprising at least three layers having different characteristics, at least one of the layers having a thickness less than or equal to 0.030 inches; heating and forming the multi-layer member to obtain half cups in a portion of the multi-layer member; separating the half cups from the rest of the multi-layer member by cutting; providing a center of the ball and placing the center in a mold and positioning the two half cups to surround the center; assembling the two half cups together by applying heat and pressure around the center; and removing the ball from the mold.

One embodiment of the method further comprises producing the cover from at least three layers of thermoplastic. Producing the multi-layer member may consist of preparing a substantially flat multi-sheet laminate. Producing a multi-layer member may also comprise the step of extruding at least two layers separately, then joining the layers together by hot pressing or calendaring. The cover may be produced from at least three layers of thermoplastic.

In another embodiment of manufacturing a golf ball, producing a multi-layer member comprises the step of co-extruding the multi-sheet laminate.

The step of heating and forming the multi-layer member may advantageously consist of placing the multi-sheet laminate adjacent a female mold having a concave shape and exerting a pressure by a male die having a convex shape which forces the laminate to conform to the shape of the female mold. A vacuum may be applied to help pull the laminate into the female mold.

In a variant, the step of heating and forming the multi-sheet laminate comprises: positioning the laminate over the female mold and pulling the laminate into the female mold by exerting a force solely by a vacuum. Before forcing the laminate by vacuum, the laminate is softened by heating.

In yet another embodiment of the method, the multi-layer member is a multi-layered parison produced by co-extrusion. The step of heating and forming the multi-layer member consists of capturing the multi-layered parison in a mold, forcing gas into the mold to conform the parison to the impression of the mold so as to form a hollow shaped member comprising a plurality of half-cups, and removing the hollow shaped member from the mold. A further step consists of separating the half-cups from the rest of the hollow shaped member by cutting.

A preliminary step of the method desirably consists of preparing a solid core by heat curing a compound composed of polybutadiene cis-1,4, acrylic and/or methacrylic acid or a metal salt of acrylic and/or methacrylic acid, a filler and peroxide. After heat-curing the solid core, a relatively thick mantle of thermoplastic is assembled around the core to form the center of the ball. The core is desirably placed in an injection mold and a molten thermoplastic is injected around the core to form the mantle. The half cups of the mantle may be pre-injected and then assembled to the core by heat-molding in a mold.

In another aspect of the invention, there is disclosed a golf ball comprising a core and a multi-layered cover surrounding the core which comprises at least three layers. The at least three layers have a different hardness so as to provide a variation of hardness within the multi-layered structure. In one embodiment, the multi-layered cover includes a mantle comprising an innermost layer surrounding the core. Desirably, the hardness of the mantle is from 65 shore D to 74 shore D.

In another embodiment, the cover further includes a first intermediate layer surrounding the mantle, the first intermediate layer having a hardness from 55 shore D to 64 shore D, a second intermediate layer surrounding the first intermediate layer, the second intermediate layer having a hardness from 25 shore D to 54 shore D, and an outermost layer surrounding the second intermediate layer, the outermost layer having a hardness from 45 shore D to 65 shore D. In another embodiment, the outermost layer has a hardness from 40 shore D to 50 shore D.

DETAILED DESCRIPTION OF THE PREFERRED EMBODIMENT

Figure 1:
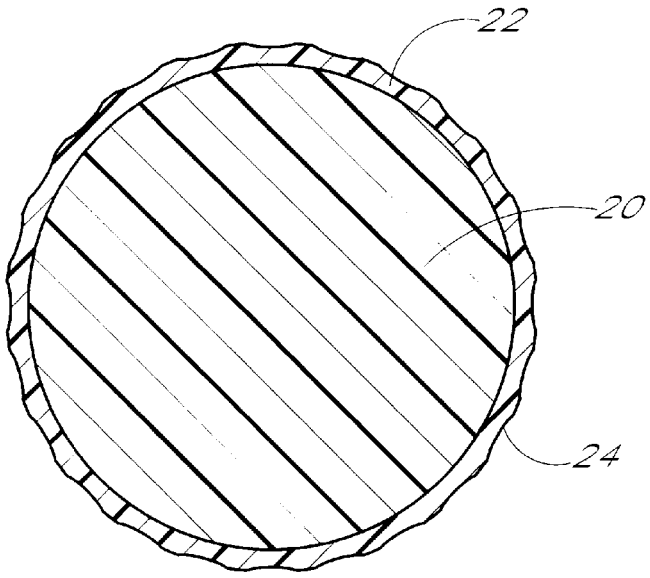
FIG. 1 (PRIOR ART)
FIG. 1 is a cross-sectional view of a two-piece golf ball of the prior art.
Figure 2:
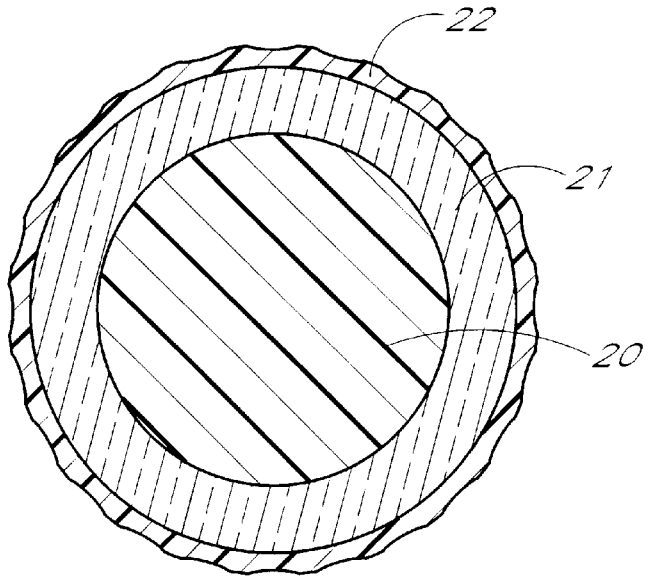
FIG. 2 (PRIOR ART)
FIG. 2 is a cross-sectional view of a three-piece golf ball of the prior art.
Figure 3:
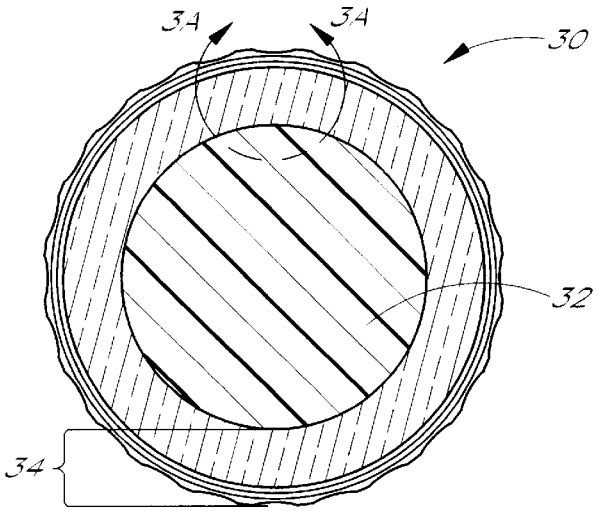
FIG. 3 is a cross-sectional view of a golf ball configured in accordance with a first embodiment of the present invention.
Figure 3A:
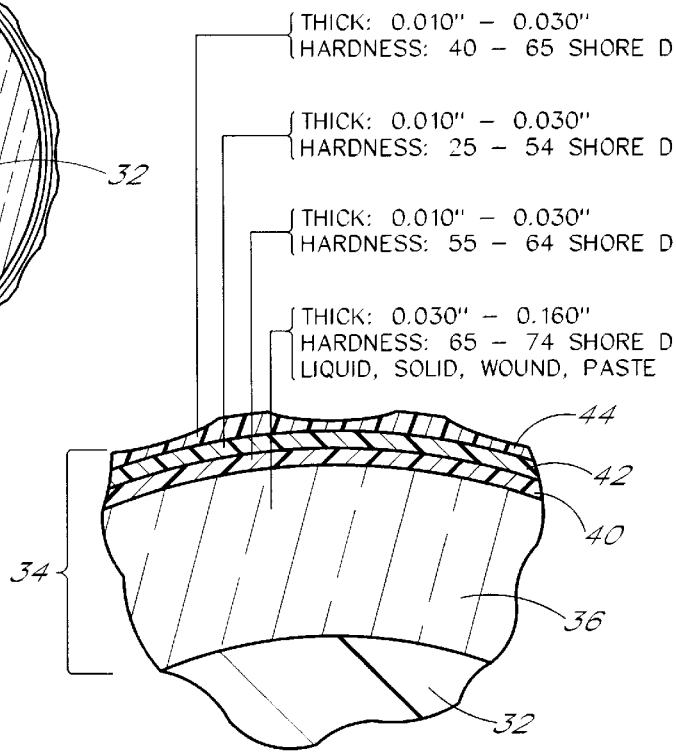
FIG. 3A is an enlarged view of a portion of the golf ball within 3A—3A of FIG. 3.

FIG. 3 illustrates a cross-sectional view of a golf ball 30 configured in accordance with one embodiment of the present invention. The golf ball 30 includes an internal core 32 surrounded by a cover 34. As best shown in FIG. 3A, the cover 34 consists of a multi-layer structure that includes at least three layers, and preferably more than three layers, with each layer having a thickness less than or equal to 0.03 inches. Although it is possible to have layers of less than 0.005 inches in thickness, from a commercial practicality standpoint, each layer desirably has a thickness of at least 0.005 inches. Preferably, the thickness of each layer is from 0.010 inches to 0.025 inches, and, more preferably, from 0.012 inches to 0.015 inches. In the illustrated embodiment, for clarity, the cover 34 includes an inner mantle 36 and a three thin layers 40, 42, 44 that surround the mantle 36. A thickness greater than 0.03 inches lessens the interaction between the core and the cover at impact and reduces ball performance.

The hardness and thickness of each layer vary in magnitude relative to each other, preferably as a function of the layer's distance from the outer surface of the ball 30. For instance, the hardness of the individual layers may gradually either decrease or increase in a radial direction. In the preferred embodiment of the ball 30, the hardness of the multi-sheet structure generally decreases gradually from the mantle 36 radially toward the outer surface, with the exception of the outermost layer 44 which has a hardness that is either higher or lower than the hardness of its inner adjacent layer 42. This structure has significant advantages, in that the reaction of the ball 30 varies depending upon the amount of deformation of the ball 30 upon impact with a golf club.

Preferably, the layer to which the club deforms the ball controls the reaction of the ball upon impact. For example, the mantle 36, which is generally deformed only when the ball is struck by a wood or long iron, may be relatively hard in order to support the impact of wood-type clubs and long irons and provide increased distance off the tee. Likewise, the innermost layer 40, which is generally deformed when the ball is struck by the medium irons (Nos. 4–7, for example), may be made softer than the mantle 36 to provide feel and control to the ball 30. The intermediate layer 42, which deforms when the ball is struck by one of the short irons (Nos. 8-SW) may be made even softer. Finally, the outermost layer 44 may be made harder than layer 42 to provide a solid impact feel when putting, such as is preferred by many players. The layer 44 may also be configured to provide resistance to abrasion.

The mantle 36 is preferably a relatively thick layer of thermoplastic material. In a preferred embodiment, the mantle 36 is relatively hard, such as between 65 and 74 shore D. This range of hardness values gives the ball a solid feel at impact to increase velocity and also reduce spin when the ball is hit sufficiently hard to deform the mantle 36, which generally occurs with a wood-type club or another similar long club. Thus, the properties of the mantle 36 are desirably directed toward the ball 30 being struck by a longer club. The mantle 36 also prevents excessive deformation of the core and limits the absorption of energy of the core 32 upon impact by causing the ball to spring quickly off the club face.

The thickness of the mantle 36 is preferably selected so that the mantle 36 may be manufactured using common methods, including heat compression molding and injection molding around the core 32. The thickness of the mantle 36 preferably ranges between 0.030 to 0.160 inches. Additionally, the mantle 36 preferably is made of a material with a high flexural modulus in order to impart a high speed to the ball when struck by a long club.

Preferred attributes of the layers 40–44 are set forth as follows: The mantle 36 has a hardness between 65 and 74 shore D, and is preferably 72 shore D; the layer 40 has a hardness between 55 and 64 shore D, and is preferably 60 shore D; the layer 42 has a hardness between 25 and 54 shore D, and is preferably 35 shore D; and the layer 44 has a hardness between 45 and 65 shore D, and is preferably 50 shore D .

A ball with such properties has good rebound characteristics when hit with a driver or similar long club as a result of the hard and thick mantle 36. The soft feel and high spin of the ball 30 gradually increases moving from the mantle 36 to the exterior surface (except for the outermost layer 44) so as to correspond to a progressive decrease in the deformation of the cover 34.

In an alternative embodiment, the outermost layer 44 may also be made softer than its adjacent inner layer 42 in order to impart a soft feel to the ball 30 when putting. For example, the hardness of the layer 44 in such a case may desirably range between 40 and 50 shore D. A preferred example has the following properties: the hardness of the mantle 36 is 72 shore D; the hardness of layer 40 is 60 shore D; the hardness of layer 42 is 50, shore D; and the hardness of layer 44 is 40 shore D. Such a ball has similar properties as the previous example but with a softer feel when the ball experiences slight or no deformation, such as during putting.

The particular hardness distribution described above is preferred in that the reaction of the ball varies based upon the deformation experienced, so that the ball properties are optimized for each type of club, although the distribution of hardness within the cover 34 may be modified in any of a wide variety of combinations. The number of layers in the cover 34 is not limited to the numbers described herein and a higher number of thin layers is envisioned. For example, one or more layers may be provided for each club. A total of three layers is a preferred minimum and one hundred layers is a preferred maximum. Desirably, one or two layers are dedicated per club or at least per group of clubs of the same nature.

Additionally, the cover may also consist of soft and hard layers for certain ranges of clubs. For instance, a first inner set of layers could consist of a soft layer and a hard layer directed toward a driver or other long club. Moving outward, a second set of layers could consist of a soft layer and a hard layer directed toward the medium irons. Finally, a third set of layers could consists of a combination of a hard layer and a soft layer for short irons. The combination of hard and soft layers in a set provides both distance and feel for the type of club that deforms the ball to the location of that set of layers.

The core 32 preferably contains polybutadiene having more than 40% of cis-1,4 bond, as well as an unsaturated carboxylic acid and/or metal salt thereof to cross link the polybutadiene. The unsaturated carboxylic acid or metal salt thereof may include acrylic acid and methacrylic acid and a metal salt thereof, such as zinc. The core 32 may also include a filler such as zinc oxide, barium sulfate, calcium carbonate, silica, or calcium oxide. The core 32 may also include a cross-linking agent, such as organic peroxide. The core 32 may also consist of a wound threaded structure. Additionally, the core 32 may be manufactured of a combination of solid material, such as rubber, surrounded by wound thread, or could alternatively consist of a liquid or paste filled center surrounded by wound thread. The diameter of the core 32 varies between 0.90 and 1.60 inches and has a PGA compression of 25 to 110. Such values provide desired restitution and durability characteristics to the ball 30.

Figure 4:
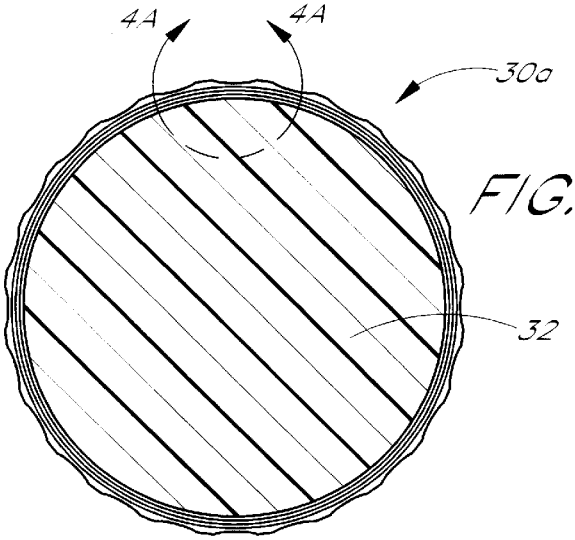
FIG. 4 is a cross-sectional view of a golf ball configured in accordance with a second embodiment of the present invention.
Figure 4A:
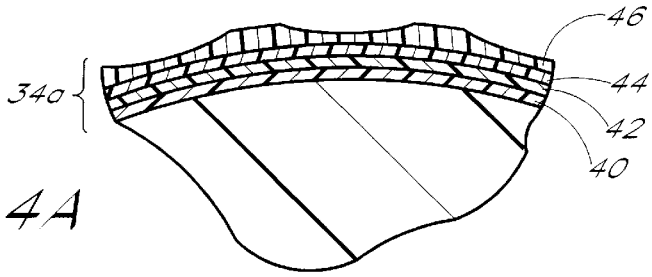
FIG. 4A is an enlarged view of a portion of the golf ball within 4A—4A of FIG. 4.

FIGS. 4 and 4A are cross-sectional views of a golf ball 30a configured in accordance with an alternative embodiment of the invention. The golf ball 30*a* consists of an internal core 32 surrounded by multi-layered cover 34*a* with no mantle.

As best shown in FIG. 4A, the cover 34*a* includes four distinct layers 40, 42, 44, 46, which are preferably each less than 0.030 inches thick. Each layer has unique characteristics of hardness, flex modulus, and thickness that may be adjusted in any of a wide variety of combinations to vary the attributes of the golf ball 30*a* as a function of the amount of deformation to the ball at impact. For instance, each layer 40–46 preferably has a hardness value that is different from the hardness value of an adjacent layer. In a preferred embodiment, the hardness of each layer generally decreases travelling from the innermost layer 40 toward the outermost layer 46 so that the layer 40 is harder than the layer 42 and the layer 42 is harder than the layer 44. The outermost layer 46 may be either harder or softer than the inner adjacent layer 44 depending upon whether a hard or soft putting feel is desired. Although the hardness configuration described above is preferred, those skilled in the art will appreciate that various other hardness combinations are possible without departing from the spirit of the invention.

As described above with respect to the previous embodiment, the minimum number of layers is preferably three and the maximum number of layers is preferably approximately one hundred.

Figure 5:
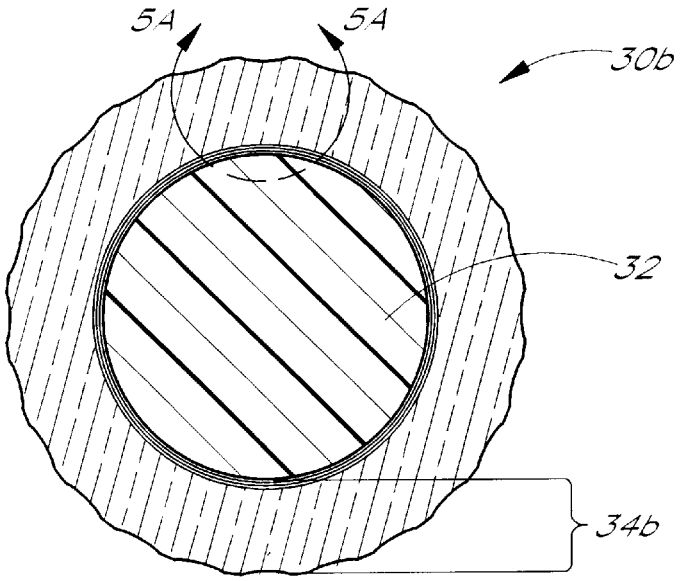
FIG. 5 is a cross-sectional view of a golf ball configured in accordance with a third embodiment of the present invention.
Figure 5A:
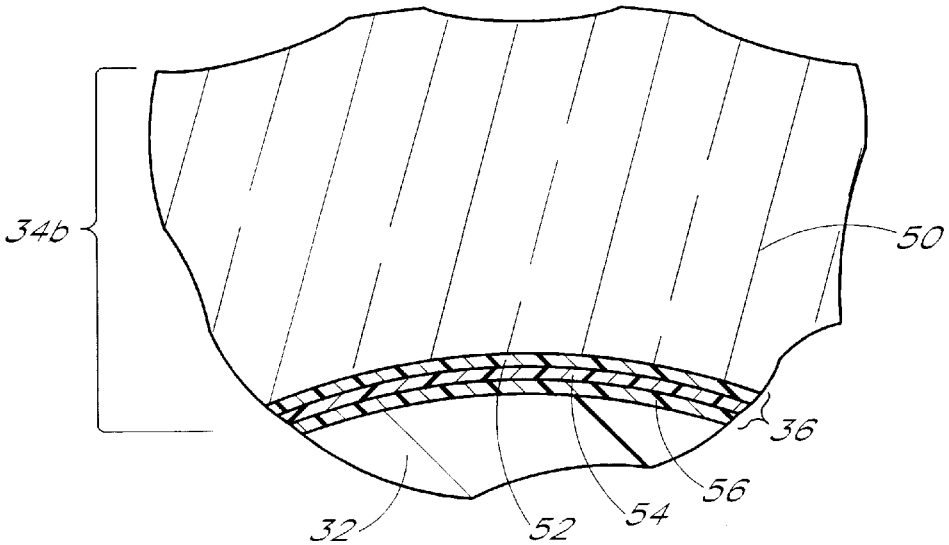
FIG. 5A is an enlarged view of the portion of the golf ball within 5A—5A of FIG. 5.

FIGS. 5 and 5A illustrate cross-sectional views of a golf ball 30*b* configured in accordance with yet another embodiment of the invention. The golf ball 30*b* includes a cover 34*b* that surrounds an inner core 32.

As best shown in FIG. 5A, the cover 34*b* consists of a thin mantle 36 and a relatively thick envelope 50 that surrounds the mantle 36. The mantle 36 consists of at least three thin layers 52, 54, and 56 that each have a preferable thickness less than or equal to 0.030 inches. The thickness of the envelope 50 preferably is between 0.030 and 0.2 inches.

The multi-layered structure of the cover 34*b* is preferably configured so that the hardness of the cover 34*b* gradually increases from the innermost layer 56 to the envelope 50. Preferably, the core 32 has an advantageously low value of PGA compression, such as, for example, 50 and lower, as measured with a compression ATTI gauge. In contrast, the cover is stiffer and desirably has a relatively high value of hardness. Specifically, the cover would have a hardness of 55 to 74 shore D. The softer inner layers of the cover cushion the harder outer layers to provide a soft feel to the ball upon impact. Additionally, the interaction between the increased deformation of the soft inner layers and the resistance to deformation of the harder outer layers at impact generates backspin to generate lift and increase ball distance. Furthermore, the hard and thick envelope 50 also provides the ball 30*b* with increased travelling distance upon impact by reducing excessive deformation of the core so that the ball propels quickly off the club face. Because the layers 52, 54 are very thin, a larger diameter low compression core 32 may be used to help increase velocity and distance.

Preferred hardness attributes of the layers 52, 54, 56 and the envelope 50 are set forth as follows: the layer 56 preferably has a hardness between 25 and 45 shore D; the layer 54 preferably has a hardness between 35 and 55 shore D; the layer 52 preferably has a hardness between 45 and 65 shore D; and the envelope 50 preferably has a hardness that ranges between 55 and 74 shore D.

Material suitable for manufacturing any of the embodiments of the multi-sheet cover 34 are preferably chosen among the group consisting of ether block copolymers, ionomers, thermoplastic urethane elastomers as well as mixtures thereof. The preferred ether block copolymer is the amide block copolyether which is known as PEBAX and sold by ATOCHEM. However, those skilled in the art will appreciate that other ether block copolymers may also be used, such as ester block polyethers (PEBE). Ester block polyethers have a rigid phase of the polybutadiene terephthalate type (PBT). These materials are also known under the trademark HYTREL by Du Pont.

The ionomers are intended to be the ionomers resins obtained by providing a cross-metallic bond to polymers of monoolefin with at least one member selected from the group consisting of unsaturated mono- or di-carboxylic acids having at least 3 to 12 carbon atoms and ester thereof, Ionomers include the VLMI (Very Low Modulus Ionomers) as well as the intermediate and high flex ionomers. Any number of a wide variety of these materials may be used to make the layers of the cover 34, and may also be used to manufacture the mantle 36. Ionomers are well known under the trademark SURLYN, which is sold by the Du Pont Company. Another ionomer is IOTEK which is sold by the EXXON Company. The layers can also contain other agents in small amounts, such as a rubbery agent and the like.

In each of the embodiments of the golf balls described herein, the core absorbs energy at impact and releases the energy to propel the golf ball from the club face. The surrounding cover provides feel and also produces spin that partially results from the different deformation characteristics of the cover and core. The cover also limits the deformation and amount of energy absorbed by the core so that the ball rapidly propels from the club face.

The golf balls of the present invention may not be produced by the well-known methods usually used to mold covers, such as heat compression molding of preinjected cups or injection molding. This is because the thicknesses of the individual layers of the multi-sheet structure are much too low to permit the use of these techniques. Set forth below is an original and new method to mold golf balls that include very thin layers of thermoplastic material.

Figure 6:
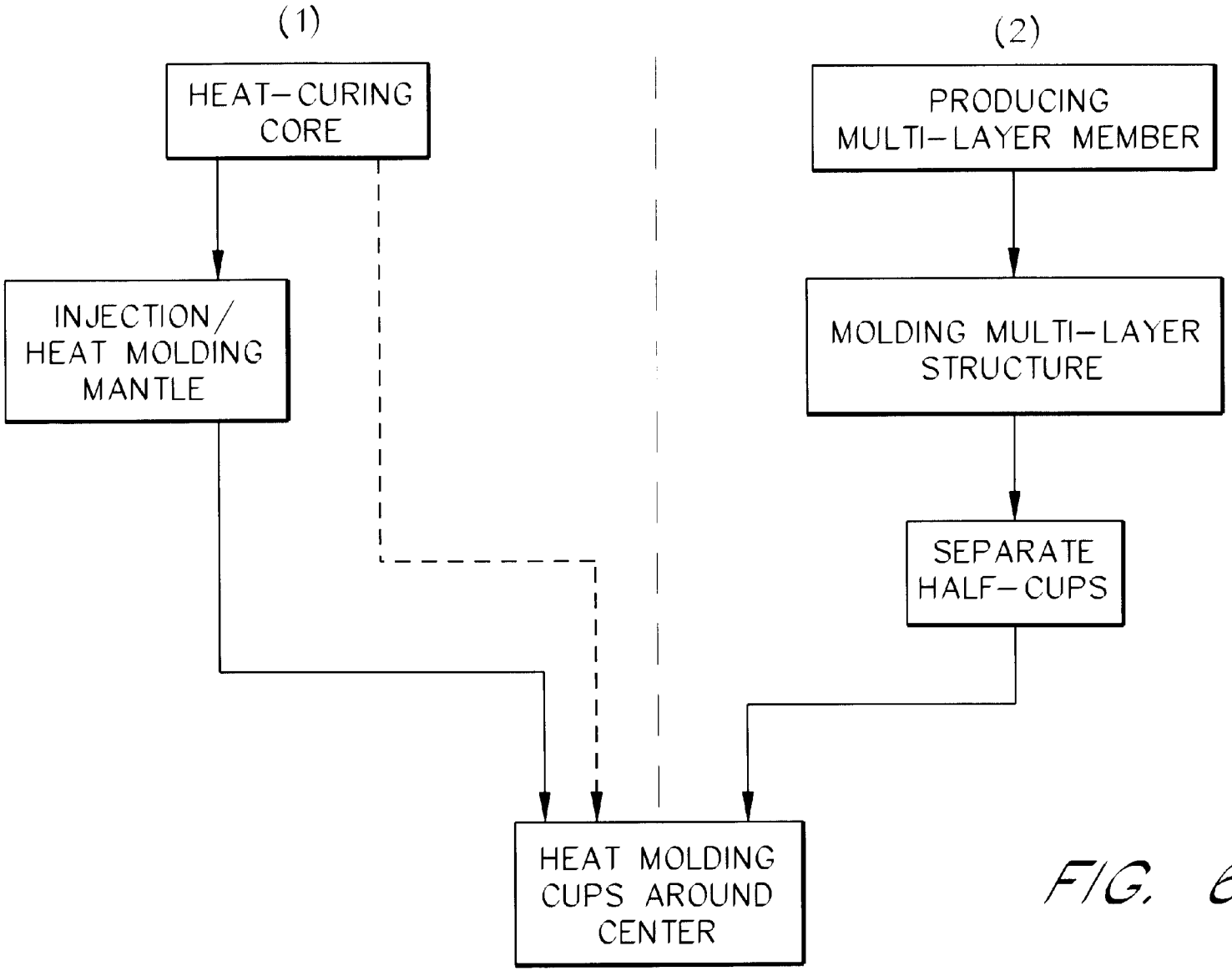
FIG. 6 is a flow-chart diagrammatically illustrating a method of producing the golf ball of the present invention.

FIG. 6 diagrammatically illustrates the general steps of the preferred method of manufacturing the golf balls 30 of the present invention. As shown, the method is generally divided into two processes. One process, identified as process (1), involves the preparation of the golf ball center (i.e., the portion of the golf ball not including the cover). Another process, identified as process (2) involves the preparation of at least a part of the multi-layered cover. After the center and cover are both prepared, they are assembled to form a final golf ball 30, such as by performing a heat compression molding process.

Referring to FIG. 6, a first step involves heat curing the core 32. This is preferable for a cover 34 having a relatively thick mantle 36, such as is shown in FIGS. 3 and 3A. If a mantle is to be used, the mantle is then assembled around the core, preferably by injection molding. The assembled core 32 and mantle 36 collectively form a center of the ball. The relatively high thickness of the mantle 36 permits the use of conventional techniques for assembling such a two-piece center. For example, the core 32 may be placed in an injection mold and maintained in place using retractable pins in a well known manner. A molten thermoplastic material is then injected around the core 32 to form the mantle 36. Another method of mounting a thick mantle 36 to the core consists of preinjecting two separate pieces, such as half cups (i.e., semi-spherical shells), to form the mantle 36. The separate pieces are then attached to the core by heat compression molding.

The center of the ball 30 may also consist of only the core 32, such as is shown in FIGS. 4 and 4A. In this case, there would be no need to attach a mantle to the core and process (1) would only consist of heat curing the core 32 (as shown by dashed lines in FIG. 6).

As shown in FIG. 6, the method of manufacturing the ball cover is illustrated as process (2). As shown, the cover preparation process generally includes producing a multi-layer member, molding the multi-layer member into the shape of the golf ball, such as into two separate cups or halves, and then separating the cups by cutting. The separate pieces of the cover 34 are then mounted around the ball center, such as through heat molding. The process is described in detail below.

Figure 7A:
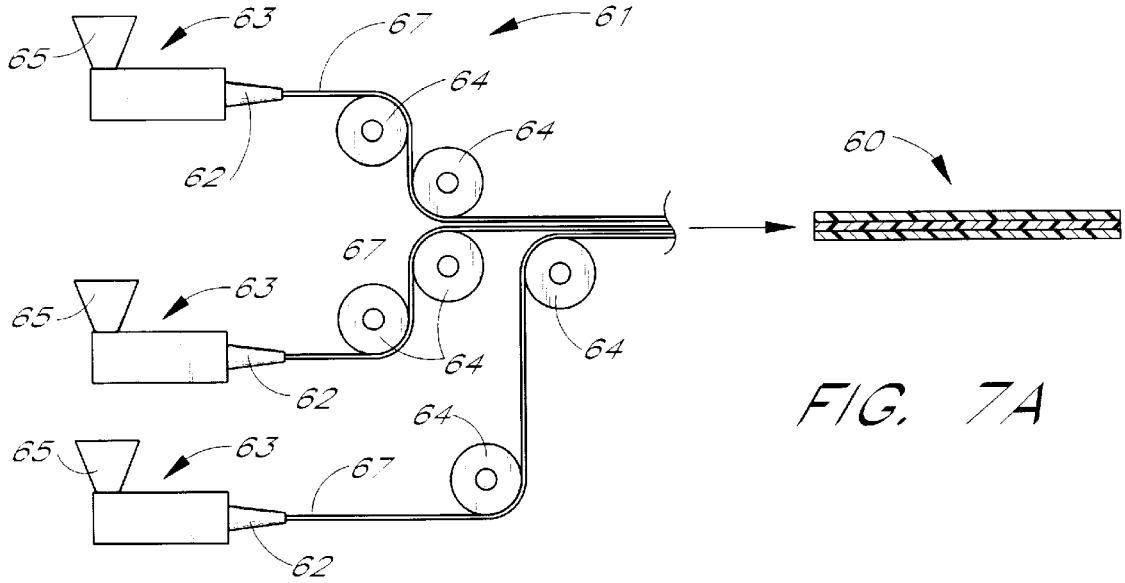
FIGS. 7A–E illustrate the steps in a method of manufacturing the golf balls of the present invention.

FIGS. 7A–7F illustrate the various steps comprising a method for producing a golf ball 30 having multi-layer cover 34 such as described herein. Referring to FIG. 7A, a first step involves the production of a multi-layer member 60. The multi-layer member 60 preferably consists of a substantially flat multi-sheet laminate structure. The multi-layer member 60 may be obtained by separate extrusion of several thin layers of thermoplastic. The layers are assembled together by calendaring or hot pressing to form the multi-layer member 60.

FIG. 7A schematically illustrates a mechanism 61 for manufacturing and pressing together the layers of the multi-layer member. The mechanism 61 includes a plurality of extrusion devices 63 that each include a receptacle 65 for holding plastic material in the form of pellets or powder. A die structure 62 converts the plastic material into a layer or film 67 in a well known manner. Preferably, each extruded film 67 comes out of the die structure 62 at a continuous rate. The films 67 are then moved through a series of rollers 64 that guide and press the films together to produce the multi-layer member 60. Thermofusible adhesive films may be added between the layers to ensure adhesion of one layer to an adjacent layer. The thickness of such films is preferably only several mils. It is also contemplated that the multi-layer member 60 may be produced by co-extrusion of three or more thermoplastic films.

The number of layers in the multi-layer member 60 preferably consists of three to twenty layers, or more if necessary. Each film 67 in the multi-layer member 60 preferably has a thickness less than or equal to 0.030 inches, although higher thicknesses may be used. The arrangement, number and specific characteristics of the films 67 is dependent on the desired final characteristics of the multi-layer member 60.

Figure 7B:
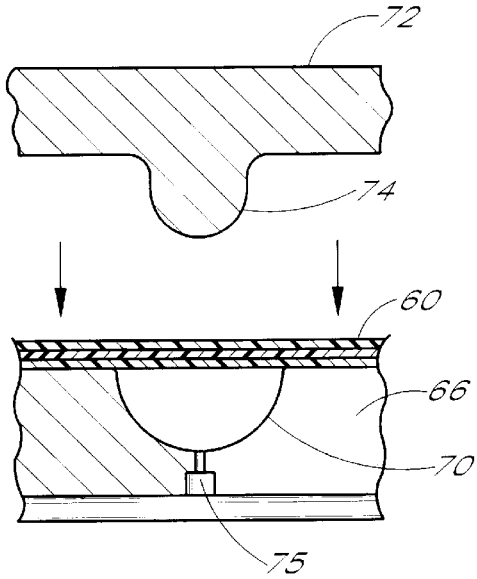

As shown in FIG. 7B, the multi-layer member 60 is next positioned adjacent a female mold 66. The female mold 66 includes a cavity 70 having a concave shape that conforms to the exterior shape of the golf ball 30 to be produced. As shown, a male mold 72 has a protrusion 74 that has a convex shape that conforms to the shape of the cavity 70 so that the protrusion 74 fits into and mates with the cavity 70.

Figure 7C:
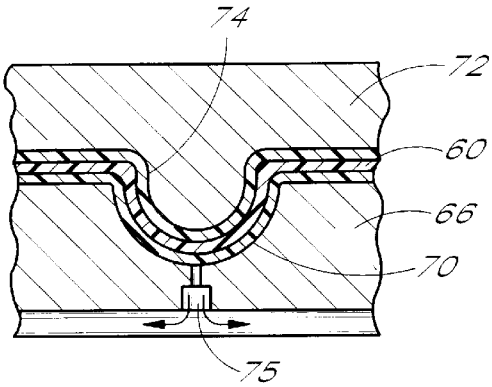
Figure 7D:
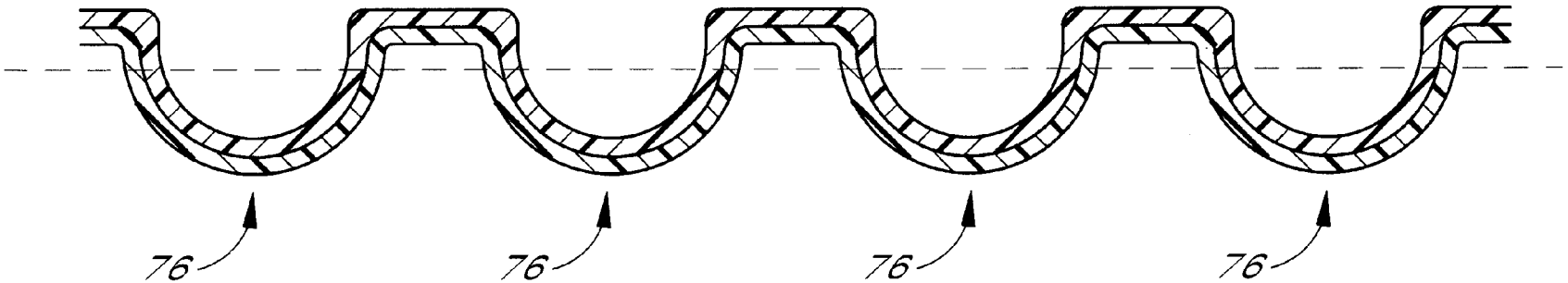

Prior to placing the multi-layer member 60 adjacent the cavity 70 in female mold 66, the multi-layer member 60 is preferably softened by heating. The protrusion 74 of the male mold 72 is then inserted into cavity 70 of the female mold 66 with the multi-layer member 60 positioned therebetween. As shown in FIG. 7C, the softened multilayer member 60 thus conforms to the shape of the cavity 70. Preferably, a vacuum is pulled within the cavity 70 through a conduit 75 in order to facilitate movement of the multi-layer member 60 into the cavity 70.

In a variant of the invention (not shown), the multi-layer member is positioned adjacent a female mold, clamped by clamp means and then the multi-layer member is pulled into the cavity solely by a force created by a vacuum. The use of a male die is not necessary in this case. Generally the multi-layer member is heated until it softens before applying the vacuum step.

As shown in 7D, the multi-layer member 60 forms into at least one half-cup 76 (i.e., a semi-spherical shell) as a result of the molding process described above. It is contemplated that a plurality of half-cups 76 may be produced from a single multi-layer member 60 using a female mold 66 that has a plurality of cavities 70. Each half-cup 76 has a shape that conforms to the shape of half of a completed golf ball 30. The half-cups 76 may be separated from one another by cutting, such as for example, by using a knife, water jet, laser beam, etc.

Figure 7E:
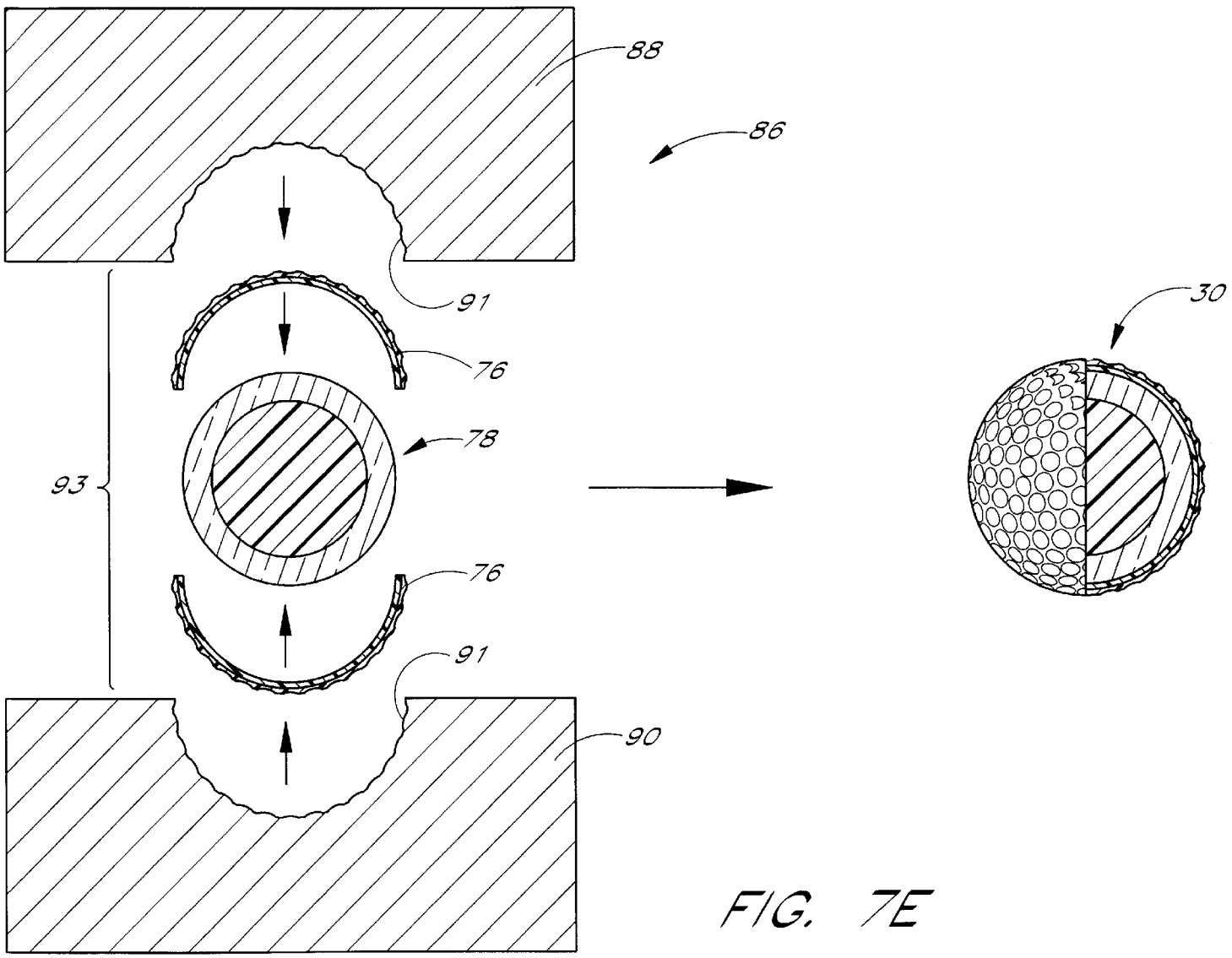

FIG. 7E illustrates a next step in the manufacturing method in which two half cups 76 are assembled around a golf ball center 78 by heat compression molding to produce a completed golf ball 30. This step involves the use of a mold 86 that includes two halves 88, 90. The halves 88, 90 each have a semi-spherical cavity 91. When assembled together, the cavities 91 in the halves 88, 90 together form an internal cavity that has a shape corresponding to the shape of the completed golf ball 30. The cavities 91 preferably have dimple impressions for forming dimples on the completed golf ball 30 during molding.

As shown in FIG. 7E, two half cups 76 are positioned around a golf ball center to form an assembly 93. The assembly 93 is then positioned adjacent the cavities 91 of the mold 86 and heated, as shown in FIG. 7E. When the assembly 93 is sufficiently heated, the mold 86 is closed around the assembly 93 until the junction lines between the half-cups 76 are welded together. The dimple impressions on the cavities 91 form a dimple pattern on the outer surface of the heated assembly 93. After a period of time, the mold 86 is opened to produce a completed ball 30. The complete ball 30 is then buffed to remove the molding seams and sandblasted to provide an adhering surface for painting. The ball 30 is then painted and provided with indicia, such as trademarks and logos. A clear coat is finally applied on the ball 30.

Figure 8A:
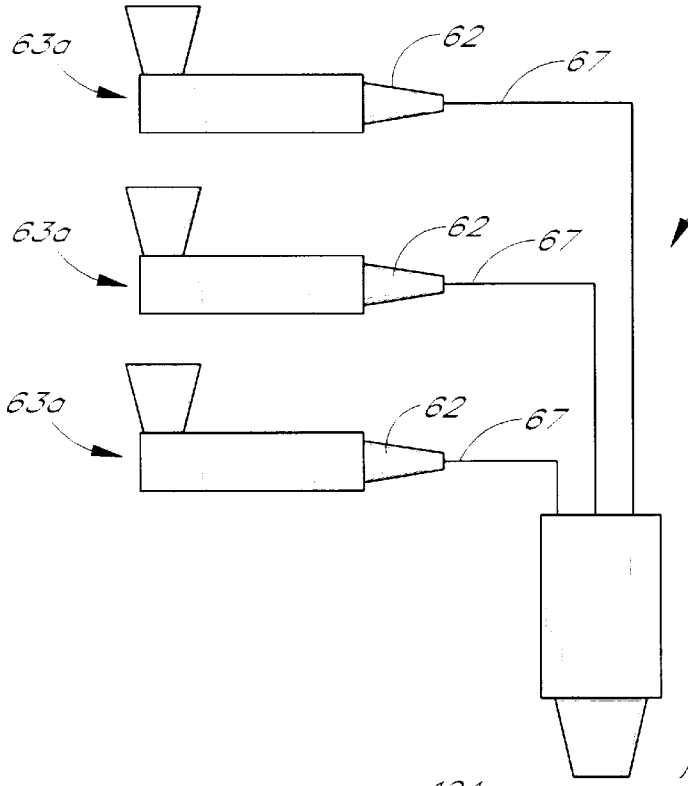
FIGS. 8A–8D illustrate the steps in alternative method of manufacturing the golf balls of the present invention.

FIGS. 8A–8D illustrate another method of manufacturing the golf balls 30 of the present invention using a blow-molding technique. Referring to FIG. 8A, a multi-layered parison 92 is produced by co-extrusion of at least three different thin films using a mechanism 61*a*. The mechanism 61*a* includes three extrusion devices 63*a* for forming the parison 92. The parison 92 is softened through heating and then placed within a two-piece mold 94.

Figure 9:
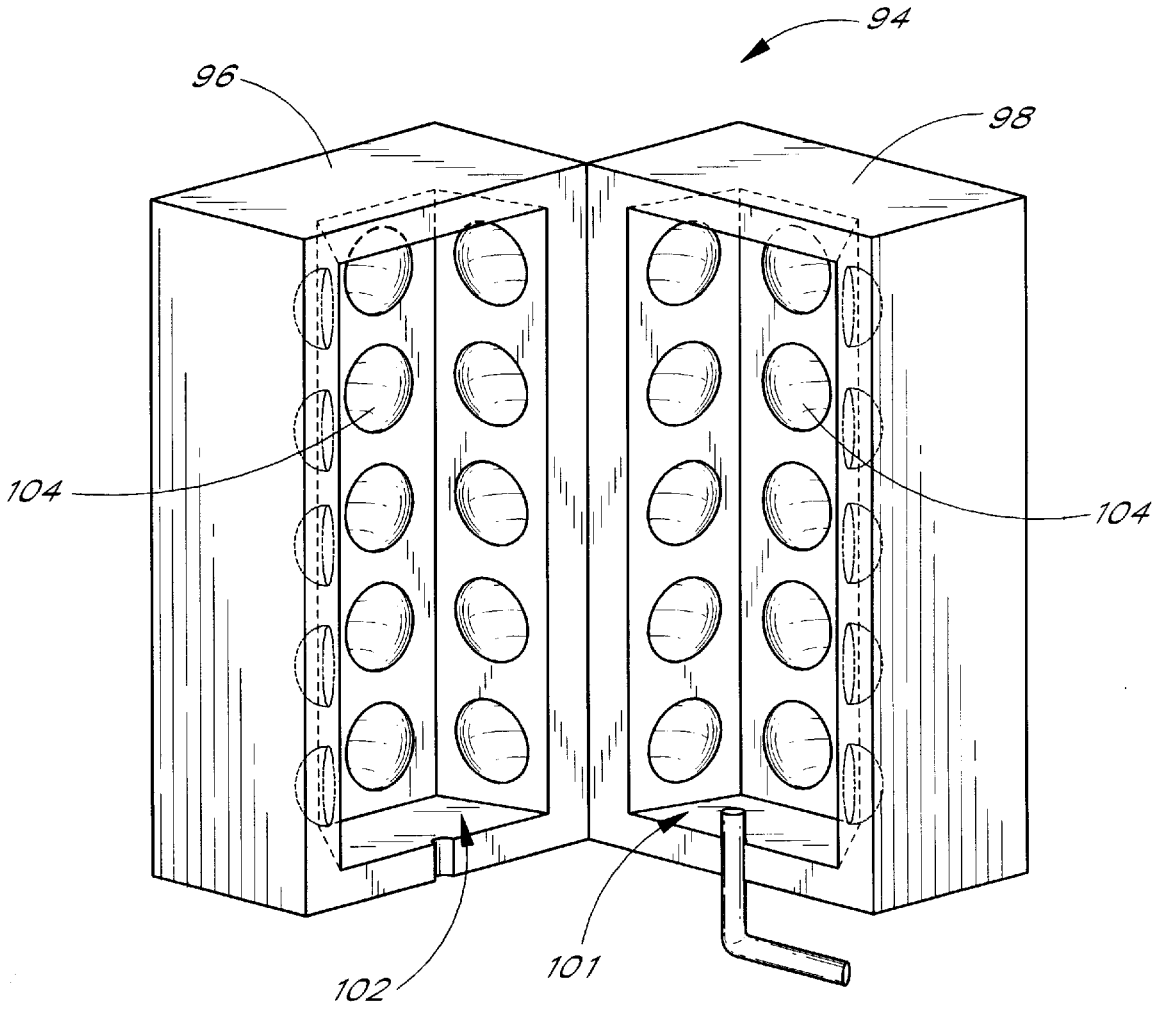
FIG. 9 is a perspective view of a mold used in the method illustrated in FIGS. 8A–8D.

FIG. 9 illustrates the mold 94 in detail. As shown, the mold 94 consists of two halves 96 and 98 having substantially identical shapes. Each halve 96 and 98 has a semi-polygonal impression 102 each including a plurality of alveoli 104 that are arranged around the periphery of the impression 102. Each alveolus 104 defines a semi-spherical shape that conforms to the shape of half of a golf ball 30. The impression 102 may have various other shapes, such as a hexagonal shape to facilitate the subsequent operation of cutting the cups from one another, as described below.

Figure 8B:
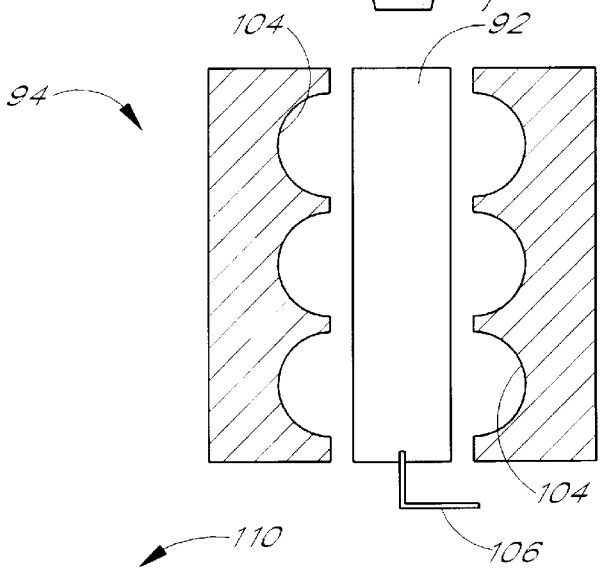
Figure 8C:
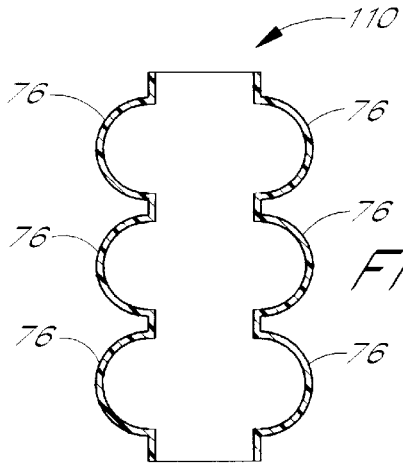

Referring to FIG. 8B, the mold 94 is next closed around the parison 92. Air is then inserted into the impression 102 of mold 94 through a blow pin 106. The air pressure within the mold 94 forces the parison 92 to form into the shape of the impression 102. Specifically, the parison 92 forms into a hollow-shaped member 110 (FIG. 8C) consisting of many half-cups 76 that are spaced apart circumferentially and longitudinally along the peripheral walls of the member 110.

The half-cups 76 are next separated from the hollow member 110 by cutting. Preferably, a circular edge is formed around each half cup 76. As discussed above, the cutting operation may be performed using various well-known techniques, such as by using a knife, water jet, laser beam, etc.

Figure 8D:
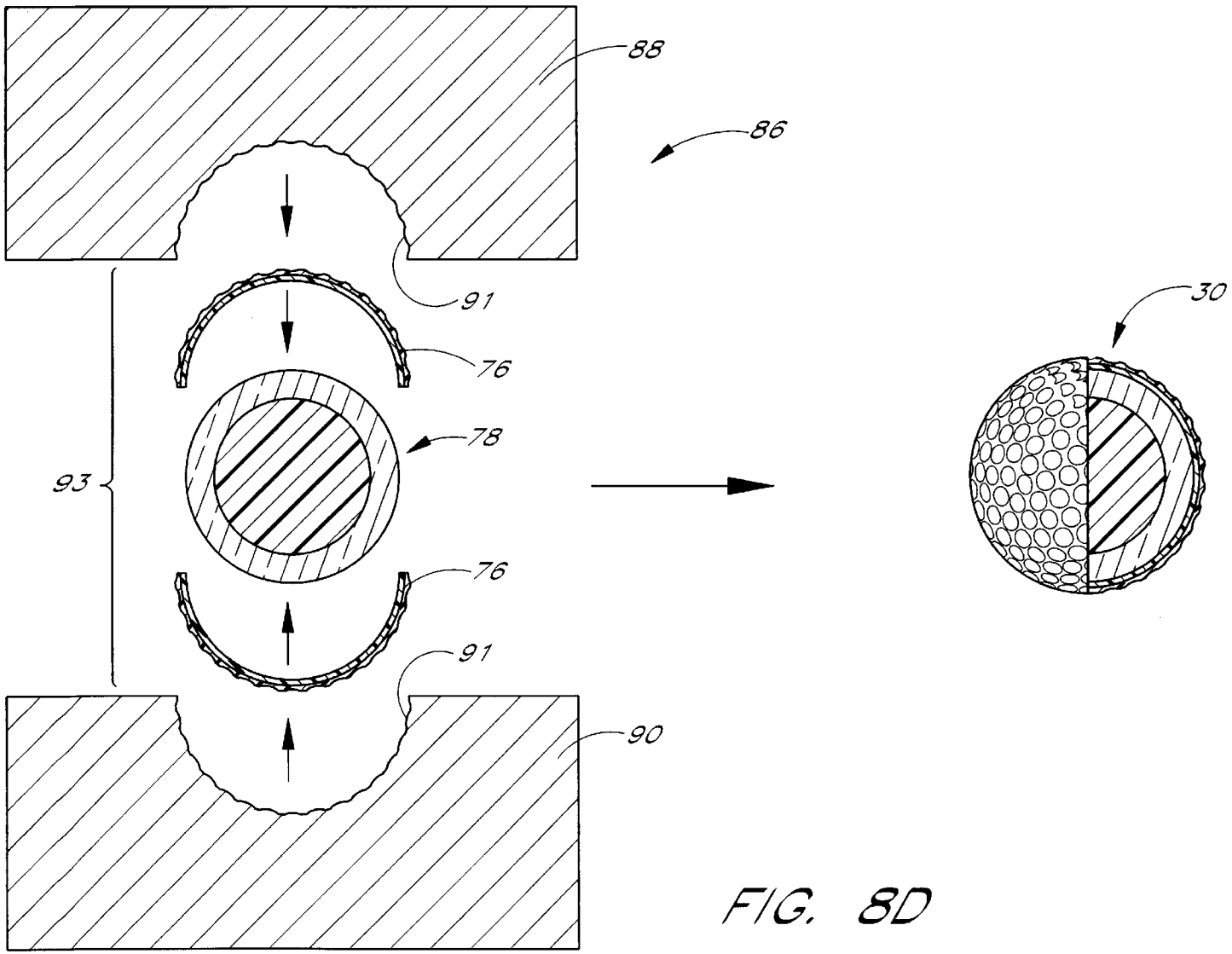

As shown in FIG. 8D, the half-cups 76 are next molded around a golf ball center to form a completed golf ball 30. Because the golf ball 30 is molded in the same manner described above with respect to the previous method no further description of this step is provided.

The layers 52, 54, 56 of the mantle 36 as shown in FIG. 5A may be produced by the aforementioned method. Such a method of preparing the mantle 36 consists of preparing a multi-layer member 60 to form half-cups, as described above. Depending upon the desired thickness of the envelope 50, the envelope 50 may be either formed as a part of the multi-layer member 60 or may be assembled separately around the thin layered mantle 36 by injection molding or heat molding of preinjected cups.

Although the foregoing description of the preferred embodiment of the preferred invention has shown, described, and pointed out certain novel features of the invention, it will be understood that various omissions, substitutions, and changes in the form of the detail of the apparatus as illustrated as well as the uses thereof, may be made by those skilled in the art without departing from the spirit of the present invention. Consequently, the scope of the present invention should not be limited by the foregoing discussion, which is intended to illustrate rather than limit the scope of the invention.

What is claimed is:

1. A golf ball comprising:

(a) a core;

(b) a multi-layered structure surrounding said core said structure comprising at least three thin layers, wherein said at least three layers each have a different hardness so as to provide a hardness gradient formed by said at least three layers of the multi-layered structure from the innermost layer to the outermost layer, and wherein said layers each have a thickness of about 0.010 inches to about 0.030 inches.

2. The golf ball according to claim 1 wherein the hardness within the multi-layered structure decreases from its innermost layer to its outermost layer.

3. The golf ball of claim 2, wherein said layers comprise thermoplastic.

4. The golf ball according to claim 1 wherein the hardness within the multi-layered structure increases from its innermost layer to its outermost layer.

5. The golf ball of claim 4, wherein said layers comprise thermoplastic.

6. The golf ball according to claim 1 wherein the core comprises a single solid rubber core.

7. The golf ball of claim 6, wherein said solid rubber core is covered with wound rubber thread.

8. The golf ball of claim 1, wherein the core comprises a liquid or paste filled center covered with wound rubber thread.

9. The golf ball according to claim 1 wherein said core comprises rubber and said golf ball further comprises a mantle disposed over said rubber core, wherein said mantle comprises a thermoplastic and has a thickness greater than 0.030 inches.

10. The golf ball according to claim 1 wherein said layers are formed from ionomers or thermoplastic elastomers, or mixtures thereof.

11. The golf ball according to claim 10, wherein said thermoplastic elastomers are chosen among the ether block copolymers or the urethane elastomers.

12. The golf ball according to claim 11 wherein said ether block copolymer is an amide block copolyether.

13. A golf ball comprising:

(a) a core;

(b) a multi-layered cover surrounding said core said cover comprising at least three layers, wherein each of said at least three layers has a different hardness so as to provide a hardness gradient formed by said at least three layers of the multi-layered cover from the innermost layer to the outermost layer, and wherein each of said layers has a thickness of about 0.010 inches to about 0.030 inches.

14. The golf ball according to claim 13, wherein each of the layers in the cover comprise a thermoplastic material.

15. The golf ball according to claim 14, wherein the core comprises an elastomer material.

16. The golf ball according to claim 15, wherein the core comprises a single solid rubber sphere surrounded with wound rubber thread.

17. The golf ball according to claim 15, wherein the core comprises a liquid or paste covered with wound rubber thread.

18. The golf ball of claim 13, wherein the multi-layered cover includes a mantle comprising an innermost layer surrounding said core.

19. The golf ball of claim 18, wherein the hardness of said mantle is from 65 shore D to 74 shore D.

20. The golf ball of claim 19, wherein said cover further includes a first intermediate layer surrounding said mantle, said first intermediate layer having a hardness from 55 shore D to 64 shore D.

21. The golf ball of claim 20, wherein said cover further includes a second intermediate layer surrounding said first intermediate layer, said second intermediate layer having a hardness from 25 shore D to 54 shore D.

22. The golf ball of claim 21, wherein said cover further includes an outermost layer surrounding said second intermediate layer, said outermost layer having a hardness from 45 shore D to 65 shore D.

23. The golf ball of claim 21, wherein said cover further includes an outermost layer surrounding said second intermediate layer, said outermost layer having a hardness from 40 shore D to 50 shore D.

* * * * *

UNITED STATES PATENT AND TRADEMARK OFFICE

CERTIFICATE OF CORRECTION

PATENT NO. : 6,068,561

DATED : May 30, 2000

INVENTOR(S) : Renard, et al.

It is certified that error appears in the above-identified patent and that said Letters Patent is hereby corrected as shown below:

Title page, item [54] and Col.1, "MULTI-LAYER GOLF AND METHOD OF MANUFACTURING",-- should be changed to "MULTI-LAYER GOLF BALL."

Signed and Sealed this

First Day of May, 2001

*Attest:*

Nicholas P. Godici

NICHOLAS P. GODICI

*Attesting Officer*

*Acting Director of the United States Patent and Trademark Office*